United States Patent [19]

Boles

[11] 4,026,050

[45] May 31, 1977

[54] GROCERY SHOPPING LIST

[76] Inventor: Bruce Aaron Boles, 419 E. 54th St., Hialeah, Fla. 33013

[22] Filed: July 6, 1976

[21] Appl. No.: 702,699

[52] U.S. Cl. ..... 40/65; 116/135

[51] Int. Cl.[2] ..... G09F 7/10

[58] Field of Search ..... 40/64 R, 65, 62, 61; 116/135

[56] References Cited

UNITED STATES PATENTS

| | | | |
|---|---|---|---|
| 1,078,573 | 11/1913 | Cock | 116/135 |
| 1,717,048 | 6/1929 | Livingston | 116/135 |
| 1,998,027 | 4/1935 | Russell | 40/64 R |
| 2,751,878 | 6/1956 | De Bodor | 40/65 X |
| 3,046,932 | 7/1962 | Rodrigue | 116/135 |

FOREIGN PATENTS OR APPLICATIONS

| | | | |
|---|---|---|---|
| 739,924 | 11/1932 | France | 116/135 |

*Primary Examiner*—John F. Pitrelli
*Attorney, Agent, or Firm*—Gustave Miller

[57] ABSTRACT

This is a shopping reminder particularly useful as a grocery shopping or reminder list for use in the home for conveniently listing grocery articles as they become exhausted, and in the grocery store for indicating the items to be purchased. It consists of two book cover members having somewhat rigid raised boundary portions and integrally connected by a flexible portion so that the cover members may be folded over each other. Secured in the raised boundary portions and through raised ribs parallel thereto are rods on which elongated parallelpiped indicator slides having grocery items individually listed thereon. Slides ae slidable to either of two positions, one to indicate the item is needed, the other to indicate that it is not needed. A hump at the mid-point of the rod yieldably permits the slide to be slid thereover. The grocery indicating slide is elongate, having a central elongate hole so that the slide may be slid along the rod, and an elongate slot connecting to the central hole, so that the side may be put on or taken off the rod at will for changing to another indicating slide if desired.

Integral hooks are provided on the end of one cover for holding the cover members in folded position or for suspending the reminder list on the inside of a grocery cart. Two spaced apart holes are located in the same end of the same cover member for hanging the unfolded reminder in the kitchen so that needed items may be listed for the next visit to the grocery store.

3 Claims, 6 Drawing Figures

GROCERY SHOPPING LIST

OBJECT OF THIS INVENTION

It is an object of this invention to provide a shopping reminder or grocery shopping list that is convenient to use in the kitchen as the need for a particular grocery item makes itself apparent, that is convenient to carry to the grocery store, and that is convenient to use in the grocery store.

A further object of this invention is to provide a shopping reminder which folds like a book or wallet for convenience in carrying, yet opens up for easy manipulation, so that it may be conveniently hung up on kitchen wall for gradually accumulating the reminder indications, that may be folded like a book or wallet for carrying on the person, and that may be opened up and hung on the back of a shopping cart.

A further object of this invention is to provide a grocery shopping list that is easily carried in the hand or in a pocketbook.

Yet a further object of this invention is to provide a shopping list provided with readily exchangeable indicator slides so that new items may be indicated when desired.

Another object of this invention is to provide a shopping list of readily moldable suitable plastic which has indicating slide carrying wires molded permanently in position, the indicating slide being readily exchangeable.

Yet a further object of this invention is to provide a grocery shopping list that is an improvement over the devices of the prior art, including U.S. Pat. Nos. 1,548,690; 1,830,030; 1,998,027; 2,230,482; 2,751,878.

BRIEF DESCRIPTION OF THE FIGURES

With the foregoing and other objects in view, this invention comprises the combination, construction and arrangement of parts hereinafter set forth, claimed and disclosed in the accompanying drawing, wherein.

DETAILED DESCRIPTION OF THE INVENTION

Figure 1:
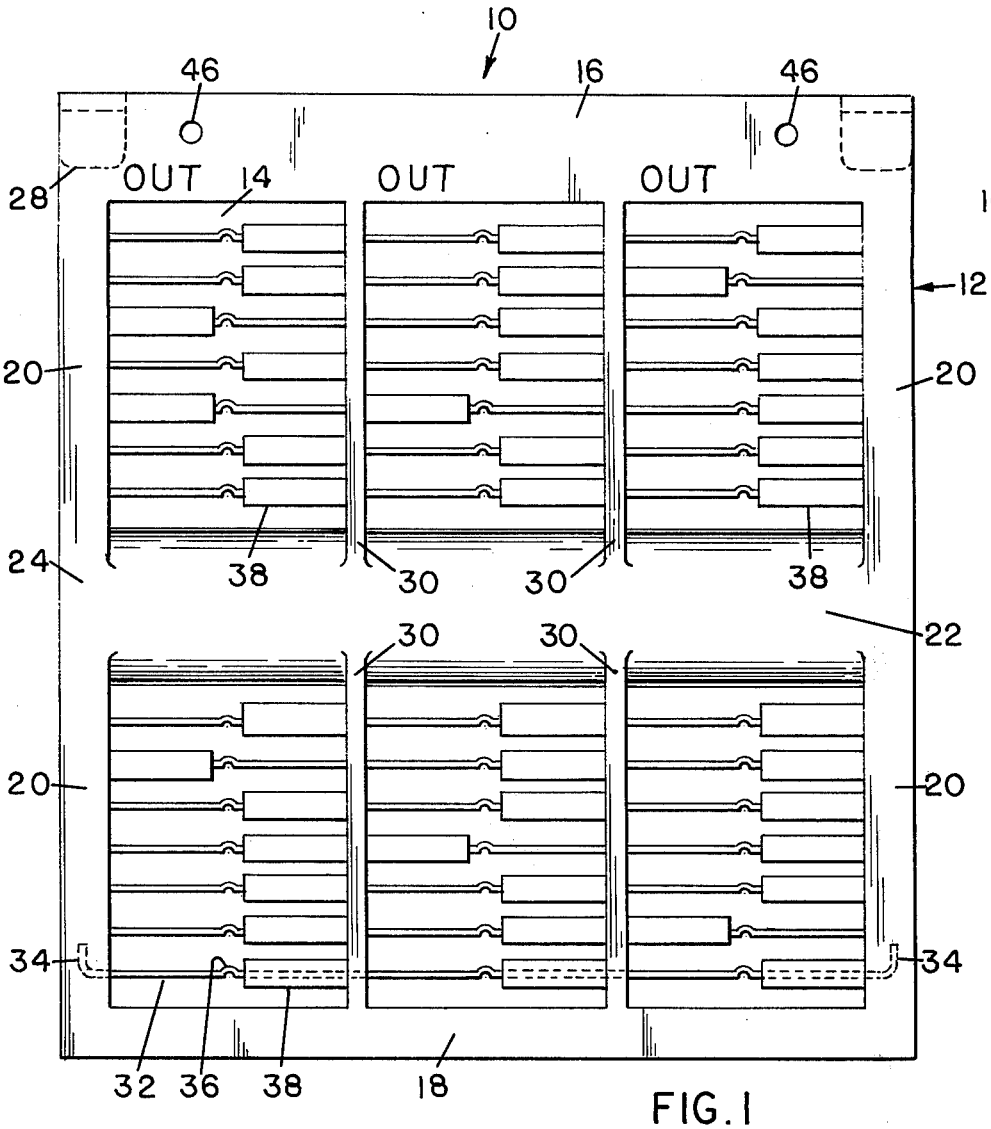
FIG. 1 is a plan view of the grocery shopping list of this invention.
Figure 2:
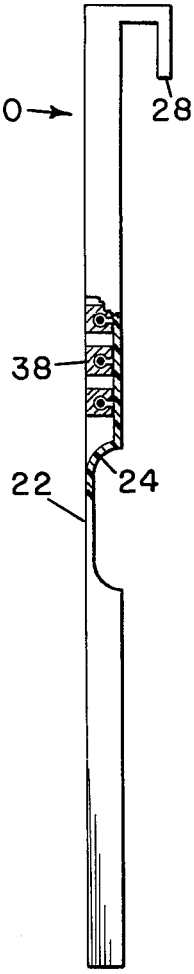
FIG. 2 is a side edge view of FIG. 1, partly in section.
Figure 3:
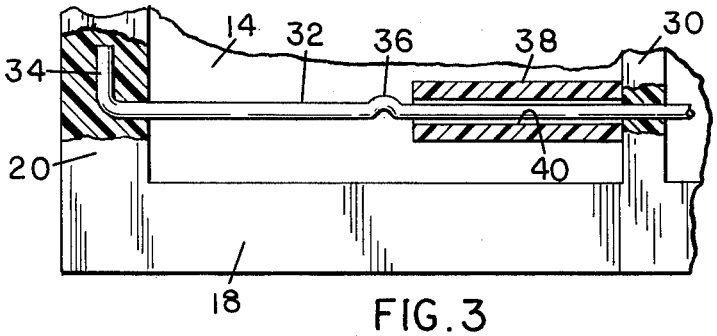
FIG. 3 is an enlarged fragmentary view, partly in section, of the lower left hand corner in FIG. 1.
Figure 6:
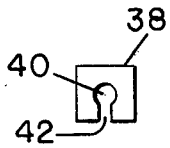
FIG. 6 is an end elevation of the slide of FIG. 5.
Figure 4:
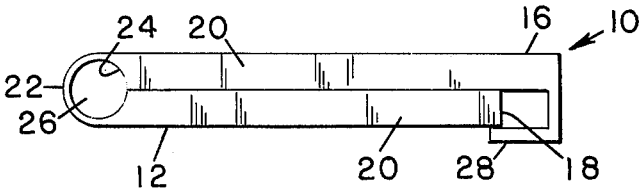
FIG. 4 is an end edge view of the invention in book shape folded position.
Figure 5:
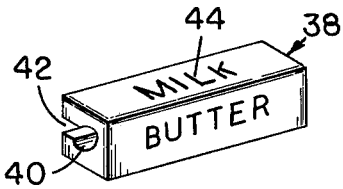
FIG. 5 is a perspective view of a typical elongate indicating slide.

There is shown at 10 the grocery shopping list or reminder of this invention. This reminder 10 includes a book form casing 12 having a flat sheet portion 14 provided with rigid raised end boundaries 16 and 18 at its opposite ends. Similar raised side boundaries 20 extend from the end boundaries 16 and 18 but stop short at the mid-area, leaving the mid-area flexible to provide an integral hinge 22. The side boundaries 20 curve smoothly down to the hinge mid-area 22 at 24, forming an open circle at 26 in FIG. 4, with the side boundaries 20 lying flat on each other, and the end lower boundary lying on part of the upper boundary 16 but slid under right angle hooks 28 integrally extending from opposite ends of upper boundary 16, as shown in FIG. 4, thus holding the casing 12 in book folded position.

A plurality of raised rigid ribs 30, parallel to the side boundaries 20, extend at right angles from the end boundaries 16 and 18 as far as the hinge area 22, and overlie each other when folded over. As shown, two ribs 30 are shown at each side of the hinge area 22, but more or less may be provided as desired. Wire slide rods 32 having right angle ends 34 are molded and anchored within the side boundaries 20, as shown, and extend through the mid-ribs 30. At the mid-point between the ribs 30, or rib 30 and side boundaries 20, a slight hump 36 is provided.

A grocery item indicating slide 38, generally elongate and parallelepiped in outline is provided having an elongate axial tunnel 40 therethrough of slightly larger diameter than the diameter of the rod 32. This tunnel 40 is connected to one side of the slide 38 by a slot opening 42 having a width just minutely less than the diameter of the side wire 32, thus enabling the slide 30 to be forced over the slide wire 32 and remain slidably thereon except when it is desired to forcibly remove or exchange one indicator slide for another.

Each indicator slide 38 carries a grocery item indication 44 on each of three of its elongate sides, it thus being possible to forcibly rotate the slide 38 when desired to change its indication, or to remove it and replace it when desired.

As shown, the length of each slide 38 is somewhat less than the distance between the rod hump 36 in the slide wire 32, so that it may be slid from one side of the hump 36 to the other side. The word OUT is shown on the upper end boundary 16 to one side of the wire hump 36. Also, two hook or nail receiving holes 46 are located in the end boundary 16 so that the reminder or shopping list may be hung on suitably placed hooks or nails in a kitchen wall.

OPERATION OF THE INVENTION

In operation, slide 38 with suitable indications 42 are mounted on the slide wires or rods 32, and the casing 12 is hung by its holes 46 on suitable hooks or nails on the kitchen wall. Then, when a kitchen item is low or OUT, the appropriate slide 38 is moved to the OUT side to thus remind the shopper on the next shopping trip. When going shopping, the reminder 10 is removed from the wall and folded over like a book or wallet for convenient carrying in a handbag.

As shown, the indicators 38 are visible when the reminder 10 is folded, and thus the shopper can read the indicator when holdng the reminder in the hand, the two portions 10 being held in folded position by the hooks 28.

Obviously, this reminder may be constructed with the hinge areas 22 and hooks 28 so reversed that the indicators are concealed when in folded position. At the grocery store or supermarket which provides shopping carts, as most do, the reminder 10 is unfolded and supported by the hooks 28 over the back wall of the basket, with the indications 44 readily visible to the shopper.

ABSTRACT OF THE DRAWING

In the drawing, like numbers refer to like parts, and for the purpose of explication, marshalled below are the numbered parts of the improved SHOPPING REMINDER of this invention.

10 shopping list or reminder 12 book form casing
14 flat portion or cover
16 raised top boundary
18 raised bottom boundary
20 side boundaries
22 mid-area hinge
24 curved down boundary to hinge
26 open circle end of hinge 22
28 hooks depending from top boundary 16
30 ribs
32 slide rods
34 anchoring ends of rods 32
36 humps in wire rods 32
38 indicator slide
40 elongate tunnel in 38
42 elongate slot connecting to 40
44 indication on slide 38

While this invention has been shown and the structure described in detail, it is obvious that this invention is not to be considered as being limited to the exact form disclosed, and changes in detail and construction may be made therein within the scope of what is claimed, without departing from the spirit of this invention.

Having thus set forth and disclosed the nature of this invention, what is claimed is:

1. A shopping reminder (10) comprising a book-form casing (12) having a pair of complementary flat rectangular covers (14), said covers being comparatively rigid, a flexible hinge portion (22) integrally securing said flat covers together for folding one over the other into closed book form, said covers having upstanding rigid end and side boundary portions (16, 18, 20), said side edge boundary portions extending to said hinge portion, a plurality of upstanding raised ribs (30) extending at right angles to said hinge portion (22) and between and parallel to said opposite side portions (20) of each cover (14), a plurality of rod members (32) anchored in said side edge boundary portions (20) in spaced apart parallel relationship through said ribs (30), said rod members being substantially straight between their anchoring ends (34) except for a mid-point hump (36) between said ribs (30), or between a rib (30) and its adjacent side boundary (20), and a plurality of indication (44) carrying longitudinal slide members (38) each having an elongate slot (42) of a size to slip over said rod (32) and a central elongate tubular opening (40) to ride on said rod and over said hump (36), said hump (36) yieldably holding said indicator slide (38) against freely sliding thereover.

2. The reminder of claim 1, and spaced apart hook portions (28) extending integrally from the end area (16) of one cover, said hook portions serving to hold said other cover in folded position thereagainst when slid thereunder, and alternatively serving for hanging the unfolded reminder over an end wall of a grocery cart when serving as a grocery shopping list.

3. The reminder of claim 2, said end area having perforation means (46) for suspending said reminder (10) on wall hook means.

* * * * *

UNITED STATES PATENT OFFICE

CERTIFICATE OF CORRECTION

Patent No. 4,026,050 Dated May 31, 1977

Inventor(s) Bruce Aaron Boles

It is certified that error appears in the above-identified patent and that said Letters Patent are hereby corrected as shown below:

On the title page, in item [76] "419" should read -- 491 --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*